US009044846B1

(12) United States Patent
Dawson et al.

(10) Patent No.: US 9,044,846 B1
(45) Date of Patent: Jun. 2, 2015

(54) ADJUSTABLE LIGHTWEIGHT CAMPING MALLET

(75) Inventors: Flyn J. Dawson, Draper, UT (US); John M. Guynn, Salt Lake City, UT (US)

(73) Assignee: TECH SWERVE LLC, Salt Lake City, UT (US)

( * ) Notice: Subject to any disclaimer, the term of this patent is extended or adjusted under 35 U.S.C. 154(b) by 281 days.

(21) Appl. No.: 13/568,769

(22) Filed: Aug. 7, 2012

(51) Int. Cl.
*B25D 1/00* (2006.01)
*B25D 1/12* (2006.01)

(52) U.S. Cl.
CPC ... *B25D 1/00* (2013.01); *B25D 1/12* (2013.01)

(58) Field of Classification Search
USPC ..... 81/19, 20, 22, 25, 26
See application file for complete search history.

(56) References Cited

U.S. PATENT DOCUMENTS

| | | | | | |
|---|---|---|---|---|---|
| 52,696 | A | * | 2/1866 | Eddy | 81/19 |
| 3,605,832 | A | * | 9/1971 | Stephens | 81/25 |
| 3,823,430 | A | * | 7/1974 | Welsh et al. | 7/146 |
| 3,896,864 | A | * | 7/1975 | Green et al. | 81/19 |
| 4,039,012 | A | * | 8/1977 | Cook | 81/22 |
| 4,803,023 | A | * | 2/1989 | Enomoto et al. | 264/45.4 |
| 4,876,928 | A | * | 10/1989 | Gaulin | 81/20 |
| 5,375,486 | A | * | 12/1994 | Carmien | 81/21 |
| 5,537,896 | A | * | 7/1996 | Halder | 81/26 |
| 6,106,755 | A | * | 8/2000 | Pfoertner | 264/135 |

OTHER PUBLICATIONS

Coleman Mallet with Peg Remover: Amazon Sports & Outdoors, http://www.amazon.com/Coleman-Mallet-with-Peg-Remover/dp/B001U9CWP6/ref=pd_si . . . , (Accessed Aug. 31, 2012).
Liberty Mountain Tent Peg Mallet/Puller: Amazon.com: Sports & Outdoors, http://www.amazon.com/dp/B001H3R7YG/ref=asc_df_B001H3R7YG2161285?smid=A1 . . . (Accessed Aug. 31, 2012).
Mallet Free Tarp Pegs/Spikes? Hammock Forums—Elevate Your Perspective, http://www.hammockforums.net/forum/showthread.php?t=51609 (Accessed Aug. 31, 2012).
Coghlan's Tent Peg Mallet & Puller: Amazon.com: Sports & Outdoors, http://www.amazon.com/Coghlans-Tent-Peg-Mallet-Puller/dp/B000E24HKS/ref=pd_sim_ . . . (Accessed Aug. 31, 2012).
Coghlans 9742 Plastic Tent peg Mallet: Amazon.com: Sports & Outdoors, http://www.amazon.com/Coghlans-9742-Plastic-Tent-Mallet/dp/B001QBZIMC/ref=pd_si . . . (Accessed Aug. 31, 2012).
(Continued)

*Primary Examiner* — Hadi Shakeri
(74) *Attorney, Agent, or Firm* — Workman Nydegger

(57) ABSTRACT

Adjustable weight camping mallet having a hollow head with interior chamber and access opening that can be selectively covered and uncovered. When uncovered, the access opening permits insertion of weighting material into the interior chamber to increase weight of the mallet head. Covering the access opening retains the weighting material within the interior chamber. The adjustable weight mallet has minimal weight, such as while backpacking, when the interior chamber is empty. When the mallet head is filled with weighting material (e.g., sand, water, wet sand, dirt, wet dirt, rocks, lead fishing sinkers, pocket knife, batteries, or combinations thereof), the weight can be increased by more than 50%, 100%, 200% or 300% depending on the volume and/or density of weighting material.

20 Claims, 7 Drawing Sheets

(56) References Cited

OTHER PUBLICATIONS

Dead blow hammer—Wikipedia, the free encyclopedia; http://en.wikipedia.org/wiki/Dead_blow_hammer (Accessed Aug. 31, 2012).

Zombie Squad, What is the best improvised camp hammer—Here are my ideas, http://zombiehunters.org/forum/viewtopic.php?f=14&t=90328 (Accessed Aug. 31, 2012).

Halfbakery: Adjustable Weight Hammer, http://www.halfbakery.com/idea/Adjustable_20Weight_20Hammer (Accessed Aug. 31, 2012).

SISU War Hammer Is a Weight-Adjustable Sledgehammer for Core Training, http://www.coolthings.com/sisu-war-hammer/ (Accessed Aug. 31, 2012).

iB:Topic:Water Filled Mallet, Backpacker, http://forums.backpacker.com/cgi-bin/forums/ikonboard.cgi?act=ST;f=8321 . . . (Accessed Sep. 28, 2012).

* cited by examiner

ADJUSTABLE LIGHTWEIGHT CAMPING MALLET

CROSS REFERENCE TO RELATED APPLICATION

N/A

BACKGROUND OF THE INVENTION

1. Field of the Invention

The invention is in the field of lightweight camping mallets for use in hammering an object, such as a tent stake.

2. Relevant Technology

Camping mallets are often used to drive in tent stakes. Such mallets are typically made of molded plastic so as to be rigid yet relatively lightweight. Example camping mallets are illustrated in FIGS. 1A-1C. FIG. 1A shows a relatively lightweight camping mallet 100 that reportedly weighs about 3 pounds and is molded from a durable plastic. The mallet includes a head 102 and a handle 104. The handle 104 includes holes 106 that reduce weight and provide means for gripping and removing a tent stake from the ground. The head 102 includes a first impact surface 108*a* at one end and a second impact surface 108*b* on the opposite end. Rather than being a solid cylinder, the head 102 includes a horizontal rib 110*a* and vertical rib 110*b* perpendicular to horizontal rib 110*a* for strength and rigidity and to reduce overall weight compared to a solid head.

FIG. 1B shows another relatively lightweight camping mallet 100' comprised of a head 112 and handle 114 of similar construction but with handle holes 116 that are an elongated hexagon to provide a different esthetic appearance and/or improved functionality in removing tent stakes from the ground. The head includes impact surfaces 118*a*, 118*b* and ribs 120*a*, 120*b*. Mallet 100' also reportedly weighs about 3 pounds.

FIG. 1C shows an extremely lightweight camping mallet 100" of similar construction and size as mallets 100, 100' but made of ABS plastic so as to reportedly weigh only 7.4 ounces. Mallet 100" also includes a head 122, handle 124, hexagonal handle holes 126, head impact surfaces 128*a*, 128*b* and ribs 130*a*, 130*b*.

Conventional lightweight camping mallets provide a tradeoff between weight and functionality. The advantage of heavier camping mallets, such as mallets 100, 100' of FIGS. 1A, 1B, is that they will more easily drive in a tent stake than the lightweight camping mallet 100" of FIG. 1C. The advantage of lightweight camping mallets, such as the mallet 100" of FIG. 1C, is that they are lighter and easier to carry, particularly when reducing weight is important, such as when backpacking. Thus, when selecting an appropriate camping mallet, a buyer must choose between increased weight and greater hammering ability, on the one hand, and decreased weight and diminished hammering ability, on the other.

BRIEF SUMMARY OF DISCLOSED EMBODIMENTS

The present invention provides a solution to the foregoing problems associated with the tradeoff between weight and hammering ability of a camping mallet. It does so by providing an adjustable lightweight mallet having a handle and lightweight hollow mallet head. The hollow mallet head includes an interior chamber and an opening that can be selectively covered and uncovered to provide access to or enclose the interior chamber. When uncovered, the access opening permits a user to insert weighting material into the interior chamber. Covering the access opening retains the weighting material within the interior chamber of the mallet head.

When it is desirable for the adjustable weight mallet to have minimal weight, such as while carrying the mallet when backpacking, the interior chamber can be empty. When it is desirable for the adjustable weight mallet to have increased weight, such as while driving in a tent stake, the interior chamber can be filled with a weighting material (e.g., sand, water, wet sand, dirt, wet dirt, rocks, lead fishing sinkers, pocket knife, coins, batteries, or combinations thereof). Such materials are readily available to campers and backpackers and can temporarily increase the weight of the mallet head by at least 50%, 100%, 200% or 300% depending on the volume and/or density of the weighting material. Increasing the weight of the mallet head can substantially increase hammering ability of the mallet (e.g., momentum equals mass times velocity such that increasing the weight of the mallet head increases its momentum).

These and other advantages and features of the invention will become more fully apparent from the following description and appended claims, or may be learned by the practice of the invention as set forth hereinafter.

DETAILED DESCRIPTION OF THE PREFERRED EMBODIMENTS

Disclosed herein are examples of adjustable weight mallets that have reduced initial weight when devoid of weighting material and increased weight when the mallet head is filled with weighting material. This permits a user to minimize the weight of the mallet when desired (e.g., when carrying the mallet while backpacking) and selectively increase or maximize the weight of the mallet head when desired (e.g., when hamming in a tent stake).

FIGS. 2-5 illustrate example embodiments of adjustable weight mallets. It should be understood that the structures and features shown in the Figures are merely exemplary and for illustrative purposes and are not to be understood as limiting the scope of the invention. Once one of ordinary skill in the art has read and understood the disclosure, it will be readily apparent how various structural features can be arranged or configured in order to provide the same or similar functionality. All such variations are within the scope of the disclosure and considered to be part of the disclosed invention.

Figure 2:
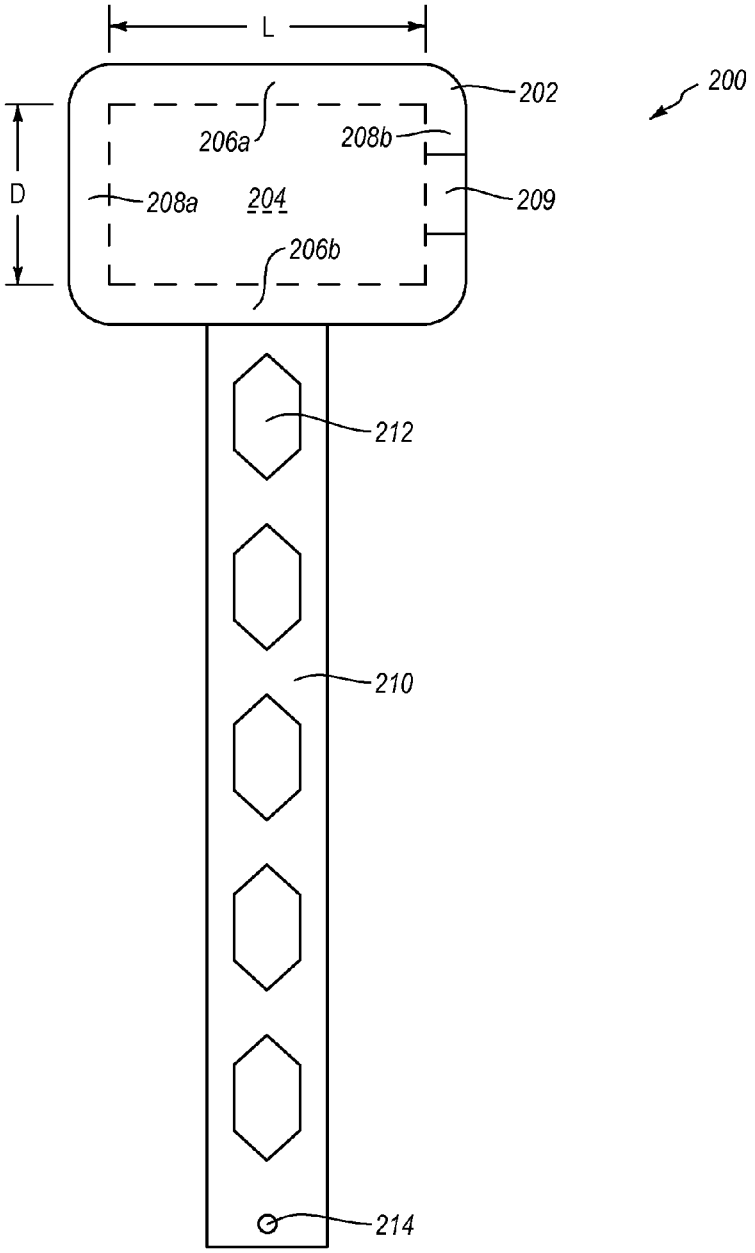
FIG. 2 is a side view illustrating an example embodiment of an adjustable weight camping mallet according to the invention having a handle, a mallet head with interior chamber, and a selectively coverable and uncoverable access opening.

FIG. 2 discloses an adjustable weight mallet 200 having a hollow mallet head 202 attached to a distal end of an elongate handle 210. The mallet head 202 includes an interior chamber 204 defined at least in part by outer wall 206, which is shown in FIG. 2 as having an upper portion 206*a* and a lower portion 206*b* adjacent to the distal end of the handle 210. The mallet head 202 further includes opposing hammer surfaces 208, including a first hammer surface 208*a* on one side and a second opposing hammer surface 208*b*. In this embodiment, first hammer surface 208*a* and a portion of second hammer surface are integrally attached to and form part of outer wall 206.

The mallet head 202 further includes an access opening 209, which can be selectively covered or uncovered to selectively provide access to or enclose the interior chamber 204. In this embodiment, the opening 209 is shown as being threaded in order to threadably receive a threaded cover or plug (not shown) that forms part of second hammer surface 208*b*. It will be appreciated that the access opening 209 can alternatively be smooth-walled, stepped, or have any other wall features that permit insertion and withdrawal of a correspondingly sized cover, cover portion, or plug (not shown). The cover can be as simply as a rubber stopper or cork that forms a compression fit within opening 209. In addition, the access opening can be positioned in any desired location through outer wall 206, such as a location between hammer surfaces 208. The mallet head can be provided with multiple openings (not shown) to provide additional access to the interior chamber 204, such as in the case where the interior chamber is subdivided in whole or in part or by one or more interior walls or strengthening ribs (not shown).

The weight of the mallet head 202 can be adjusted by selectively filling and emptying the interior chamber 204 with weighting material. The weighting material can be any appropriate material that can be inserted into the interior chamber through the one or more access holes. Non-limiting examples include sand, water, wet sand, dirt, wet dirt, rocks, lead fishing sinkers, pocket knife, batteries, or combinations thereof. Such materials are readily available to campers and backpackers and can temporarily increase the weight of the mallet head by at least 50%, 100%, 200% or 300% depending on the volume and/or density of the weighting material. The greater the specific gravity and/or bulk density of the weighting material the greater will be the weight increase of the mallet head. Increasing the weight of the mallet head can substantially increase hammering ability of the mallet (e.g., momentum equals mass times velocity such that increasing the weight of the mallet head increases its momentum).

When it is desirable for the adjustable weight mallet 200 to have minimal weight, such as when carrying the mallet while backpacking, the interior chamber 204 can be empty and filled with air or lightweight material (e.g., dehydrated food product or fishing flies). When it is desirable for the adjustable weight mallet to have increased weight, such as when driving in a tent stake, the interior chamber can be filled with weighting material. If it is desired to minimize internal movement of weighting material within the mallet head 202 during use, it may be advantageous to completely fill the interior chamber with weighting material (e.g., by filling any spaces between the outer wall 206 and solid objects such as rocks, fishing sinkers or pocket knife with sand and/or water). If a backpacker already plans on packing one or more items that can serve as weighting material (e.g., lead sinkers, pocket knife, batteries), such item(s) can be carried in the interior chamber of the mallet head with no increase in total weight of the backpack. The interior chamber can also provide storage for any desired item.

Elongate handle 210 further includes recesses 212, which reduce the weight of the handle 210 and provide means for pulling a tent stake from the ground. An auxiliary hole 214 at a proximal end of the handle 210 provides additional functionality, such as hanging the mallet 200 from a hook and/or providing means for tying the mallet 200 to a backpack or other structure using a cord. Auxiliary hole 210 can be round as shown or a flat slot to accommodate a strap.

Figure 3:
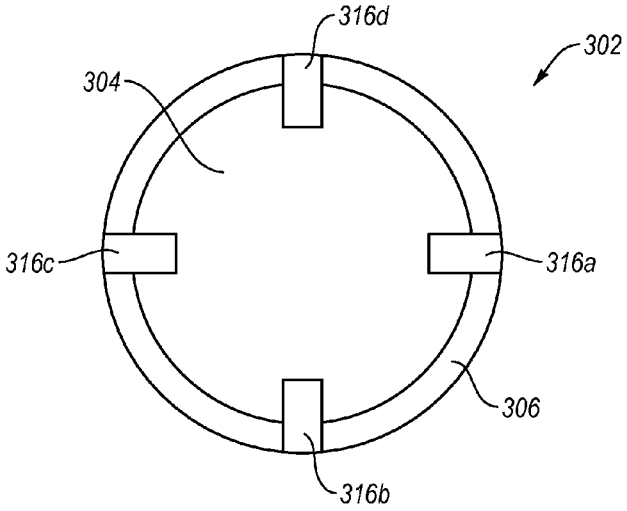
FIG. 3 is a cross-sectional view illustrating an example embodiment of a mallet head having an interior chamber formed by an outer wall and reinforcing ribs for increased strength, rigidity, and durability.

FIG. 3 illustrates an embodiment of an adjustable weight mallet head 302 in cross section. Mallet head 302 includes an interior chamber 304 for selectively placement and removal of weighting material therein. In interior chamber 304 is defined by an outer wall 306 having a circular cross-sectional shape. It will be understood that the cross section of outer wall 306 of this embodiment or any other embodiment disclosed herein can have any desired cross-sectional shape. Non-limiting examples of other possible cross sections include oval, elliptical, triangular, rectangular, pentagonal, hexagonal, and polygonal. An access hole and cover (not shown) can be provided to selectively provide access to or enclose interior chamber 304.

As shown, mallet head 302 includes a plurality (e.g., 4) strengthening ribs 316, wherein ribs 316*a*, 316*b*, 316*c*, 316*d* may be integrally formed with outer wall 306 and extend partially into the interior chamber 304. Part of one or more ribs may also protrude beyond the outer surface of outer wall 306 (not shown). It will be appreciated that any number of ribs (e.g., 1-10) can be included to provide desired strength and rigidity of the mallet head 302. For example, during hammering, the ribs 316 can help distribute compressive, flexural and other stresses across mallet head 302 in order to provide a more rigid hammering surface and prevent deformation and/or damage to mallet head 302. The ribs 316 may extend between and form a rigid bridge between two opposing hammering surfaces, such as hammering surfaces 208*a*, 208*b* of the embodiment shown in FIG. 2. Opposing ribs may alternatively join together to form a web that divides the interior chamber into sub chambers (not shown).

Figure 4A:
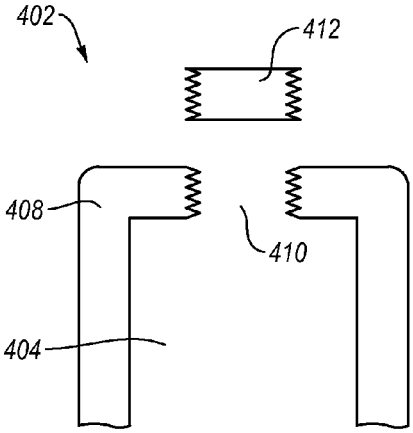
FIGS. 4A and 4B are cross-sectional views illustrating an example embodiment of a mallet head having an interior chamber, a selectively coverable access opening, and a cover that can be selectively inserted into and removed from the access opening.
Figure 4B:
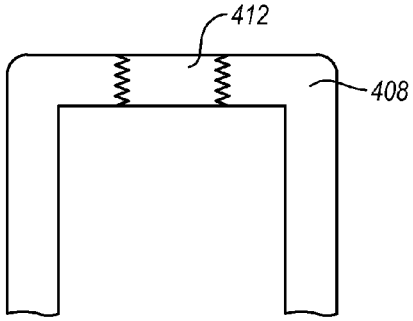

FIGS. 4A and 4B illustrate an embodiment of a mallet head with means for selectively covering and uncovering an access hole in the mallet head. Mallet head 402 includes an outer wall 408 defining an interior chamber 404 and a threaded access opening 410 through outer wall 408. A correspondingly threaded stopper 412 can be selectively removed from threaded opening 410 of outer wall 408, as shown in FIG. 4A and selectively threaded into threaded opening 410, as shown in FIG. 4B. In this way, threaded stopper 412 can selectively cover and uncover opening 410. Removal of stopper 412 from opening 410 permits weighting material to be selectively inserted into and removed from interior chamber 404. Insertion of stopper 412 into opening 410 encloses weighting material within interior chamber 404 or conveniently keeps stopper 412 together with outer wall 408 when chamber 404 is empty. A flexible leash (not shown) can interconnect stopper 412 and outer wall 408 to prevent accidental loss. Stopper 412 may include a slot, protrusion or other gripping structure (not shown) that can be engaged by a person's fingers, tool or coin when installing and removing stopper 412 from access opening 410.

Figure 5A:
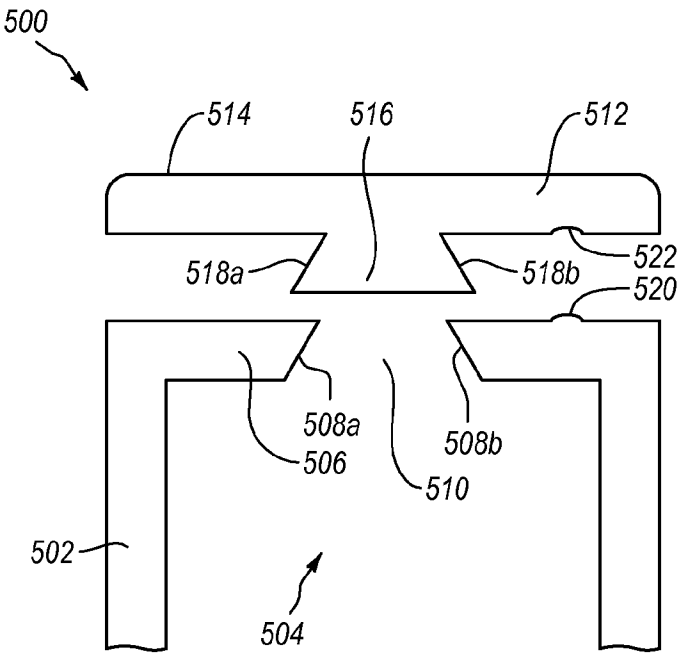
FIGS. 5A-5C are cross-sectional views illustrating another example embodiment of a mallet head having an interior chamber, a selectively coverable access opening, and a cover that can be selectively attached over and removed from the access opening.
Figure 5B:
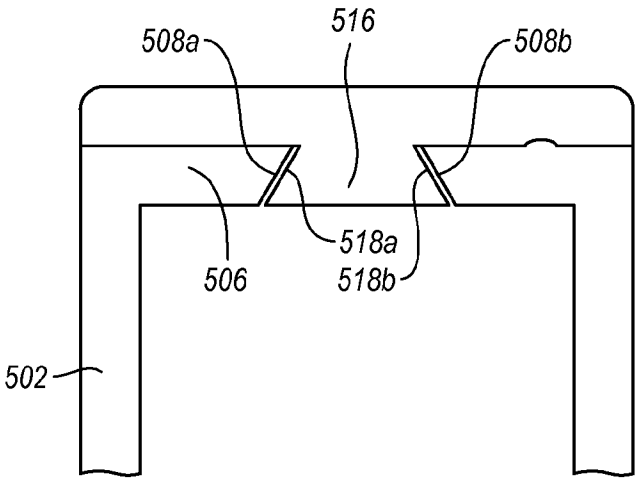
Figure 5C:
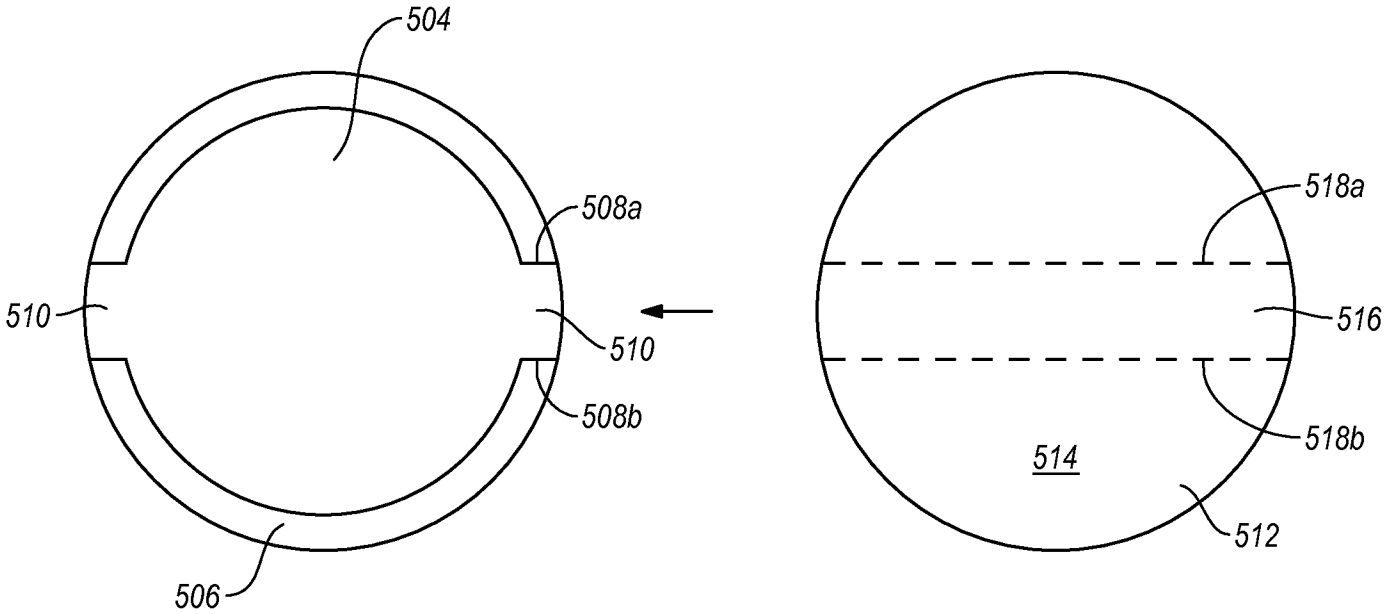

FIGS. 5A-5C illustrate another embodiment of a mallet head with means for selectively covering and uncovering an access hole in the mallet head. Mallet head 500 includes an outer wall 502 partially enclosing an interior chamber 504. An end wall 506 having an opening therethrough is integrally connected to and forms part of outer wall 502 so as to partially enclose interior chamber 504. End wall 506 further includes angled sidewalls 508*a*, 508 that form a channel or recess 510 for slidably receiving a correspondingly sized and shaped rail or protusion. A cover 512 having an outer surface 514 (e.g., hammering surface) includes a rail or protrusion 516 having angled sidewalls 518*a*, 518*b*. The rail 516 is configured to be slidably received within recess 510. This permits cover 512 to selectively cover and uncover the opening through end wall 506. A protrusion 520 on end wall 506 can mate with a corresponding recess 522 in cover 512 to restrain movement of cover 512 when attached to end wall 506. It will be appreciated that protrusion 520 and recess 522 can be reversed on cover 512 and end wall 506, respectively. At least an out surface of cover 512 may comprise metal, such as steel or aluminum, in order to provide a hard hammering surface.

FIG. 5A is an exploded view of mallet 500 with cover 512 being detached from end wall 506. FIG. 5B shows cover 512 slidably attached to end wall 506, with locking engagement of protrusion and recess. FIG. 5C shows how initially detached cover 512 can be placed over the opening through end wall 506 to enclose interior chamber 504 by slidably engaging rail 516 of cover 512 with recesses 510 of end wall 506. When rail 516 is positioned within recesses 510, sidewalls 518*a*, 518*b* of rail 516 will lie adjacent to and in slidable contact with sidewalls 508*a*, 508*b* of end wall 506. When cover 512 is positioned so as to provide access through end wall 506 to interior chamber 504, weighting material can be selectively inserted into and removed from interior chamber 504. Positioning cover 512 relative to end wall 506 so as to block access to interior chamber 504 encloses weighting material within interior chamber 504 or conveniently keeps cover 512 in a non-intrusive position relative to end wall 506 when chamber 504 is empty. A flexible leash (not shown) can interconnect cover 512 and end wall 506 to prevent accidental loss. Cover 512 may include a slot, protrusion or other gripping structure (not shown) that can be engaged by a person's fingers, tool or coin when sliding stopper 512 relative to end wall 506. Detent features or stops (not shown) can be included to limit the extent that cover 512 can slide relative to end wall 506 (e.g., to prevent complete detachment of cover 512 from end wall 506).

The lightweight adjustable weight camping mallets disclosed herein can be made from any appropriate material that can yield a mallet that is very light when not laden with weighting material. For example, they can include, in whole or in part, one or more of molded plastic (e.g., ABS, polystyrene, polyolefins (e.g., polyethylene and polypropylene), polyesters (e.g., PET, PETE, and PTFE), polyamides (e.g., nylon), PEEK, polyetheramides, polysulfones, polycarbonates, polyurethanes), molded or machined low density metal (e.g., aluminum, titanium, and low density alloys (i.e., specific gravity less than about 4.5, preferably less than about 4, 3.5, or 3), and wood. Materials are advantageously included to provide strength and durability where needed while maintaining low weight where possible. According to one embodiment, the material used to make at least part of the mallet can have a specific gravity less than about 3.0, 2.75, 2.5, 2.25, 2, 1.75, 1.5 or 1.25.

The handle and head can be integrally molded together, welded, or attached using other attachment means known in the art (e.g., threaded coupling, bayonette coupling, press fit, hinged, and the like).

According to one embodiment, the handle and head are advantageously made from a rigid plastic material that has a Young's modulus of at least about 2 GPa, preferably at least about 2.5 GPa, more preferably at least about 3 GPa. Packing a lightweight molded rigid plastic mallet head with sand or sand-water slurry so as to eliminate most or all air space (at least about 85%, 90%, 95%, 97.5% or 99%) can provide a synergistic interaction with the mallet head by reducing or eliminating the tendency to deform, crack or shatter when hammering an object when empty. The combination of lightweight plastic and tightly packed weighting material yields a mallet head that is sufficiently durable as to withstand breakable while hammering tent stakes or other objects. In this way it is unnecessary, even undesirable, to construct the head primarily or entirely of a dense, heavy metal, such as steel.

The wall thickness of the mallet head can thicker for the hammering surfaces to prevent denting or breaking (e.g., from ¼ to ¾ inch). The side walls can be somewhat thinner (e.g., from ⅛ to ¼ inch) but should be sufficiently rigid to be not easily deformable when hammering an object. The use of strengthening ribs (e.g., that are ¼ to ¾ thick) can permit the use of thinner side walls while preventing deformation. This provides maximum strength and rigidity of the mallet head while minimizing weight.

According to one embodiment, the mallet head and handle are integrally molded and/or machined as a single piece of material (e.g., plastic or aluminum). The cover or closure means can be formed separately and attached to the mallet head. A relatively thin and lightweight steel or titanium plate can be provided on one or both hammering surfaces to provide a harder surface and prevent damage to the mallet head. A circular recess on an end of the head can be provided to permit insertion of a coin or slug to provide a removable metal hammering surface.

The amount of weight that can be selectively added to the mallet head will largely depend on the volume of weighting material placed into the interior chamber and the bulk density of the weighting material. Materials with higher specific gravity may provide more weighting per unit volume. Sand, for example, has a specific gravity that is roughly three times that of water (i.e., 3 vs. 1). However, because there are spaces between sand grains, the bulk density of sand is only about 1½ times that of water (i.e., about 1.5 g/cc). It may be advantageous to fill the inter-particle spaces with water to maximize weight. For example, a cup (240 ml) of sand weighs approximately 12.5 ounces while a cup of water weighs approximately 8.4 ounces. Filling the interior chamber with one cup (240 ml) of sand will add about 50% more weight to the mallet head than one cup (240 ml) of water. However, filling the interior chamber with one cup (240 ml) of a sand-water slurry will add more weight than either sand or water alone.

The weight of one cup (240 ml) of sand is reportedly about 12.5 ounces (about 355 g). The weight of one cup (240 ml) of water is reportedly about 8.3 ounces (about 235 g). Assuming sand has a packing density of 50%, a cup (240 ml) of sand includes a half cup (120 ml) of inter-particle space that can be filled with water. That means that a cup (240 ml) of a sand-water slurry may weigh about 16½ ounces (about 475 g), or a little more than a pound. A half cup of sand-water slurry weighs about 8.3 ounces (about 235 g), or a little more than half a pound.

According to one embodiment, the interior chamber of the hollow mallet head may be proportioned to provide a volume of at least about ½ cup (about 120 ml), at least about ¾ cup (about 180 ml), at least about 1 cup (about 240 ml), at least about 1.25 cup (about 300 ml), or at least about 1.5 cup (about 360 ml). To understand how size of the size of the head and interior volume can be adjusted to accommodate a desired volume of weighting material, reference can be made to the volume of a cylinder, which is $\pi r^2 h$, where r=radius and h=height of the cylinder. A first hypothetical cylinder having a diameter of 2 inches (r=1 inch) and height (h) of 4 inches will have a volume of 12.56 $in^3$. Since a cup has a volume of 14.65 $in^3$, the volume of the first hypothetical cylinder will be about 85% of a cup and will theoretically hold about 14 ounces (about 400 g) of sand-water slurry. By way of example, a cylindrical mallet head having an outer diameter wall thickness of ¼ inch can have an outer diameter of 2½ inches and a length of 4½ inches so as to define an interior cylindrical volume having a diameter of 2 inches and a height of 4 inches.

A second, slightly longer hypothetical cylinder having a diameter of 2 inches (r=1.1 inch) and height (h) of 4.5 inches will have a volume of 14.14 $in^3$, which will hold about a pound (about 450 g) of sand-water slurry. By way of example, a cylindrical mallet head having an outer diameter wall thickness of ¼ inch can have an outer diameter of 2½ inches and a length of 5 inches so as to define an interior cylindrical volume having a diameter of 2 inches and a height of 4.5 inches.

Figure 1A:
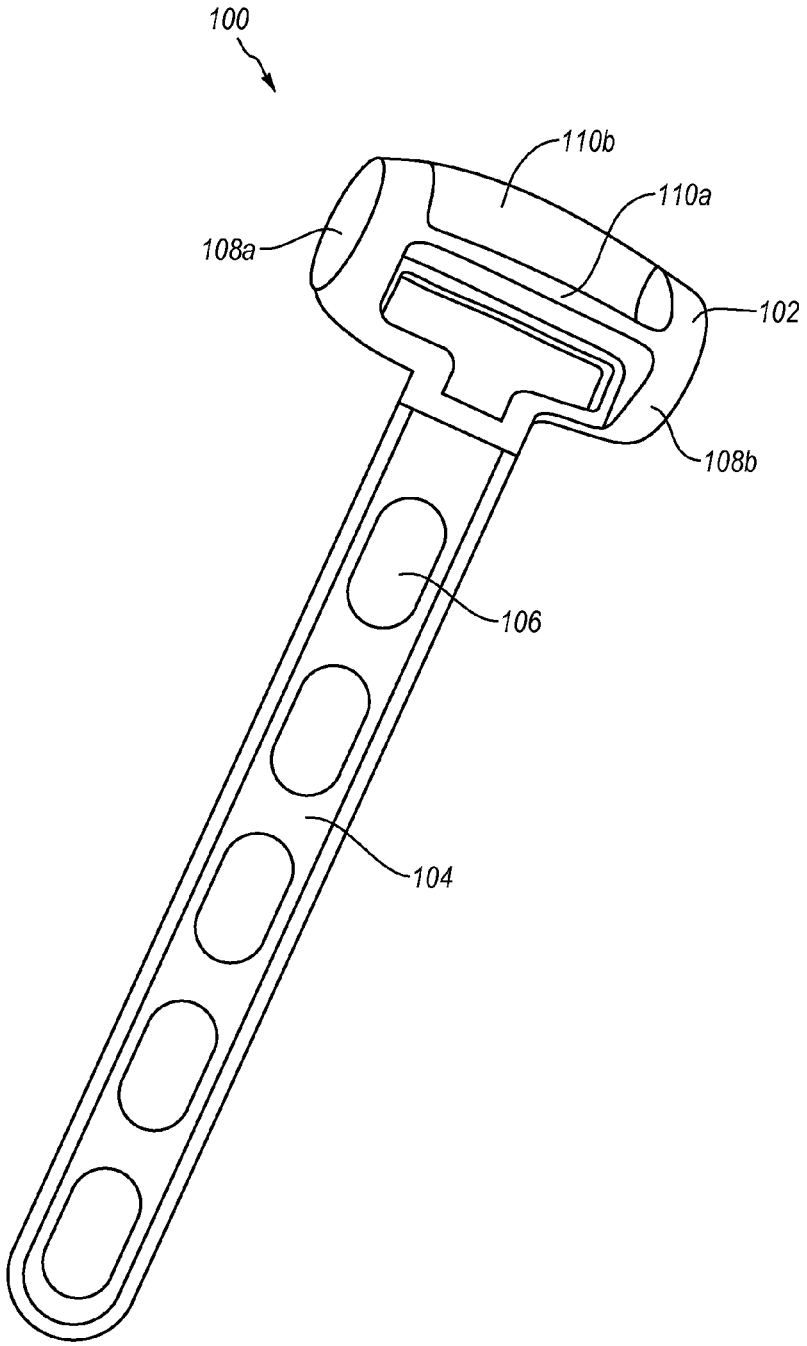
FIG. 1A (Prior Art)
FIGS. 1A-1C are perspective views illustrating commonly used lightweight camping/backpacking mallets made from molded plastic.
Figure 1B:
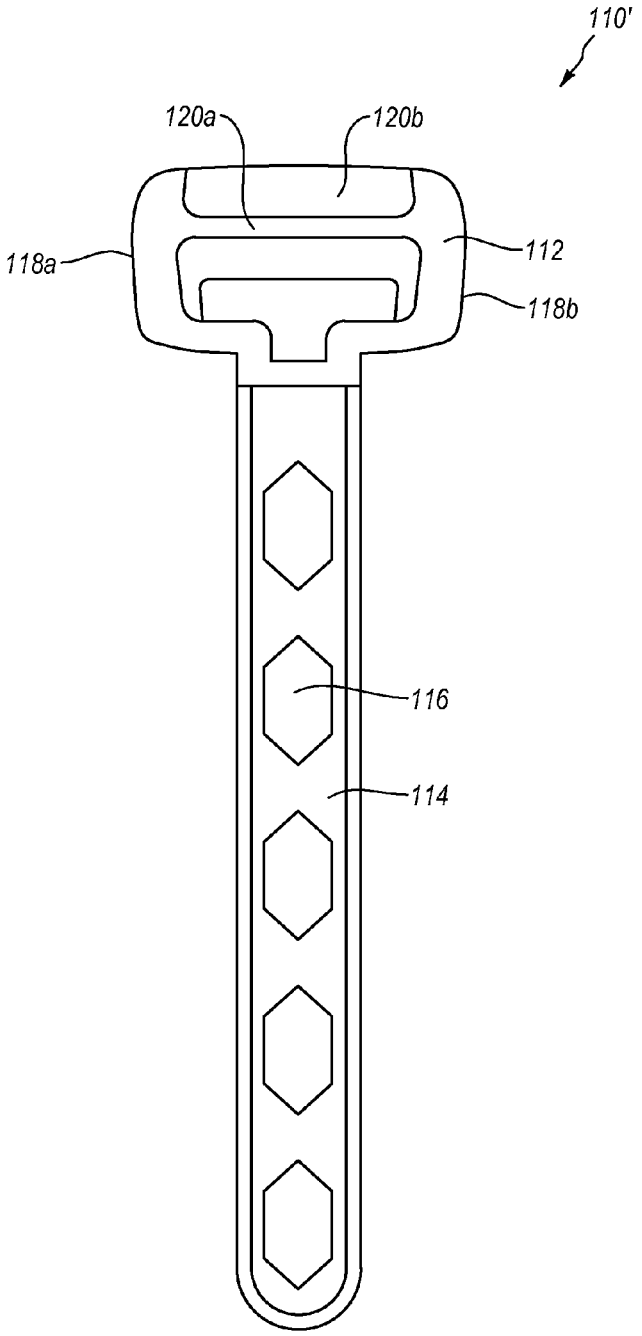
FIG. 1B (Prior Art)
Figure 1C:
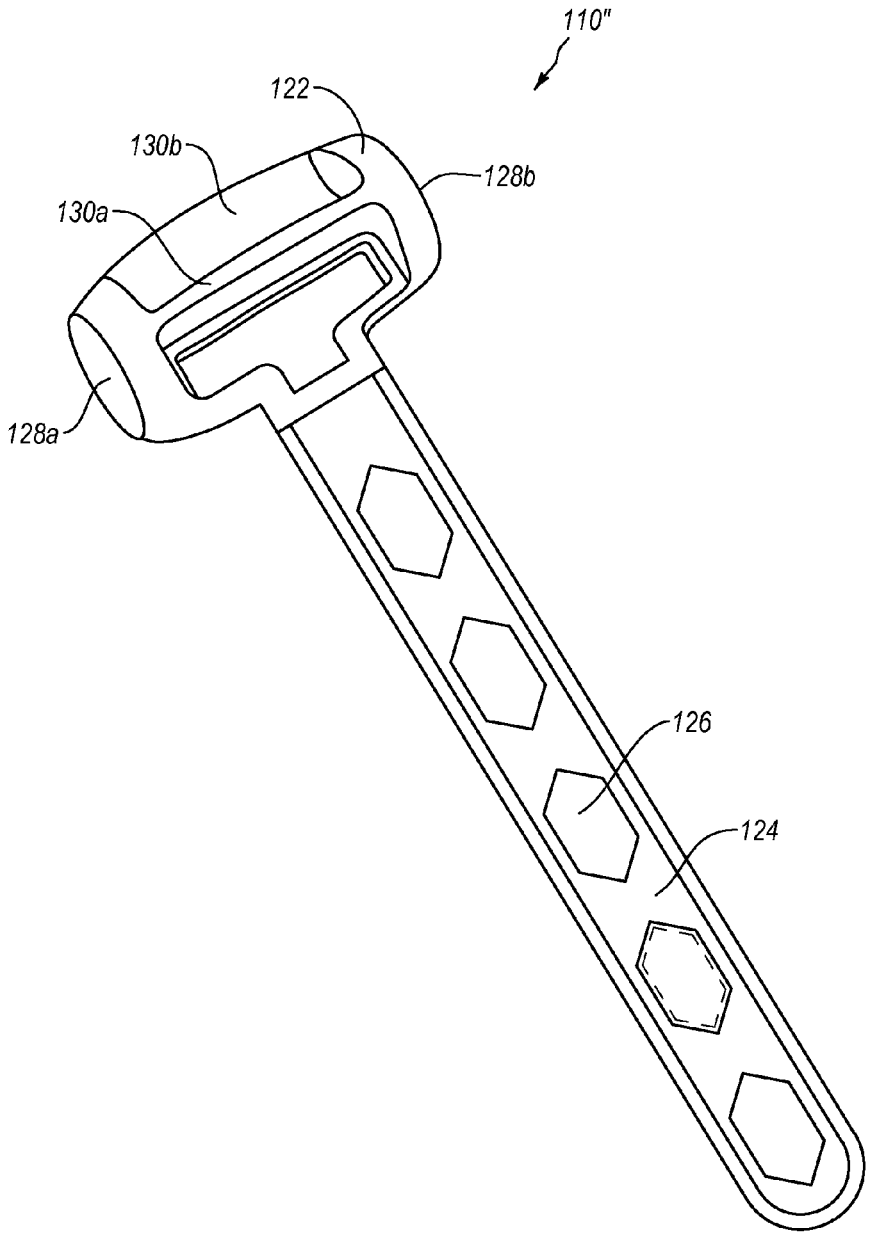
FIG. 1C (Prior Art)

By way of further example, for a lightweight mallet as in FIG. 1C having a total weight of 7.4 ounces (210 g), and assuming the head contributes 5 ounces (140 g) of weight, adding even ½ cup (120 ml) of sand-water slurry weighing 8.3 ounces (about 235 g) to the interior chamber of the mallet head will more than double the weight of the head (i.e., from 5 ounces to more than 13 ounces). Adding ¾ cup (180 ml) of sand-water slurry weighing 12.5 ounces (about 355 g) will more than triple the weight of the head (i.e., from 5 ounces to more than 17 ounces). Adding 1 cup (240 ml) of sand-water slurry weighing 16.7 ounces (about 475 g) will more than quadruple the weight of the head (i.e., from 5 ounces to more than 21 ounces). By way of comparison, adding one cup of plain water to the interior chamber of a mallet head will more than double the weight of a mallet head weighing 5 ounces. Doubling, tripling or quadrupling the mallet head will increase the striking power of the mallet head (defined as the momentum, or mass times the velocity) but a similar amount. Given the size of typical mallet heads, it is perfectly reasonable to double, triple, or quadruple the weight of the mallet head using adjustable weight mallets as disclosed herein.

The amount of increase will depend on the initial weight of the unfilled mallet head, the volume of the interior chamber, and the bulk density of the weighting material. By way of comparison, the density of water is 1 g/cc, aluminum is 2.7 g/cc, zinc (used in coins) is 7.13 g/cc, lead (used in fishing sinkers) is 11.36 g/cc, and iron (used in pocket knife blades) is 7.87 g/cc. Using lead fishing weights, pocket knife, coins, or other metal objects can further increase the weight added to the mallet head beyond using only sand water slurry, which has a bulk density of about 2.2 g/cc. Heavier objects can be placed in the interior chamber and packed tight using sand water slurry to fill up the volume and prevent or minimize rattling. In this way it may be possible to triple rather than double the mallet head weight, quadruple rather than triple mallet head weight, or quintuple rather than quadruple the mallet head weight.

The elongate handle and mallet head may advantageously be connected together or adjustable so that they are substantially orthogonal to each other. The elongate handle can have a first longitudinal axis and the mallet head can have a second longitudinal access oriented relative to the first longitudinal axis by an angle in a range of about 70° to about 110°, or between about 75° to about 105°, or between about 80° to about 100°, or between about 85° to about 95°, or between about 87.5° to about 92.5° ("substantially orthogonal).

According to one embodiment, lightweight adjustable weight mallets as disclosed herein can weigh less than about 3 pounds (about 1360 g), or less than about 2.5 pounds (about 1135 g), or less than about 2 pounds (about 910 g), or less than about 1.5 pound (about 680 g), or less than about 1.25 pound (about 567 g), or less than about 16 ounces (about 455 g), or less than about 14 ounces (about 400 g), or less than about 12 ounces (about 340 g), or less than about 10 ounces (about 285 g), or less than about 8 ounces (about 225 g) when the interior chamber is void of weighting material.

In a method adjusting the weight of an adjustable weight mallet as disclosed herein, the mallet head can have an initial weight when the interior chamber is void of weighting material. Access is provided to the interior chamber, such as by at least partially removing a cover over an access opening. The user then places one or more weighting materials into the interior chamber of the mallet head, such as sand, water, wet sand, dirt, wet dirt, rocks, lead fishing sinkers, pocket knife, coins, batteries, or other materials that can fit within the interior opening. According to one embodiment, the weighting material increases the weight of the mallet head by at least about 50% relative to the initial weight, or at least about 75%, or at least about 100%, or at least about 125%, or at least about 150%, at least about 200%, at least about 250%, at least about 300%, at least about 350%, at least about 400%, or at least about 500% relative to the initial weight of the mallet head.

According to one embodiment, the bulk density of the weighting material placed into the interior chamber of the mallet head can be at least about 1 g/cc, 1.25 g/cc, 1.5 g/cc, 1.75 g/cc, 2 g/cc, 2.25 g/cc, 2.5 g/cc, 2.75 g/cc, 3 g/cc, or 3.5 g/cc.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An adjustable weight camping mallet, comprising:

an elongate handle formed entirely of one or more materials having a specific gravity of less than about 4.5 g/cc having a first longitudinal axis and configured to be grasped by a user; and a mallet head attached to a distal end of the elongate handle and having a second longitudinal axis oriented laterally relative to the first longitudinal axis, the mallet head including:

an outer wall formed entirely of one or more materials having a specific gravity of less than about 4.5 g/cc and providing an interior surface at least partially surrounding and defining an interior chamber into which weighting material can be selectively inserted or removed;

one or more ribs extending along the second longitudinal axis to add strength and rigidity to the mallet head;

a hammering surface on a side of the mallet head and that is attached to or provided by a portion of the outer wall;

an opening through the outer wall that provides access to the interior chamber; and a cover configured to selectively cover and uncover the opening.

2. An adjustable weight camping mallet as in claim 1, wherein the elongate handle and mallet head are rigidly connected together so that the second longitudinal access is oriented relative to the first longitudinal axis by an angle in a range of about 70° to about 110°.

3. An adjustable weight camping mallet as in claim 2, wherein the elongate handle and at least a portion of the mallet head are integrally molded together as a single piece of plastic and oriented substantially orthogonally relative to each other.

4. An adjustable weight camping mallet as in claim 1, wherein the outer wall of the mallet head has a cross-sectional shape that is circular, oval, elliptical, triangular, rectangular, pentagonal, hexagonal, or polygonal.

5. An adjustable weight camping mallet as in claim 1, wherein the one or more ribs are rigidly attached to the outer wall of the mallet head.

6. An adjustable weight camping mallet as in claim 1, wherein the outer wall of the mallet head includes first threads and wherein the cover includes second threads configured to selectively mate with the first threads while selectively covering and uncovering the opening.

7. An adjustable weight camping mallet as in claim 1, wherein the outer wall of the mallet head includes one or more recessed slots adjacent to the opening and wherein the cover is a slidable cover that includes one or more corresponding rails slidably disposed or positionable within the one or more recessed slots that provide selectively covering and uncovering of the opening by the slidable cover.

8. An adjustable weight camping mallet as in claim 7, further comprising one or more stops that limit relative movement of the slidable cover relative to the mallet head.

9. An adjustable weight camping mallet as in claim 1, wherein the outer wall of the mallet head includes one or more rails adjacent to the opening and wherein the cover is a slidable cover that includes one or more corresponding recessed slots slidably disposed or positionable over the one or more rails that provide selectively covering and uncovering of the opening by the slidable cover.

10. An adjustable weight camping mallet as in claim 1, wherein the opening is disposed through a side of the mallet head adjacent to or that forms the hammering surface and wherein the cover supports or forms at least a portion of the hammering surface when the opening is covered by the cover.

11. An adjustable weight camping mallet as in claim 1, wherein the mallet head includes two hammering surfaces on opposite ends of the mallet head and wherein the opening is positioned along the outer wall at a location between the two hammering surfaces so that the cover does not form any portion of the two hammering surfaces.

12. An adjustable weight camping mallet as in claim 1, wherein the interior chamber has a volume of at least about one-half cup (about 120 ml).

13. An adjustable weight camping mallet as in claim 1, wherein the interior chamber has a volume of at least about one cup (about 240 ml).

14. An adjustable weight camping mallet as in claim 1, wherein the adjustable weight mallet weighs less than about 12 ounces (about 340 g) when the interior chamber is void of weighting material.

15. An adjustable weight camping mallet as in claim 1, wherein at least a portion of the adjustable weight mallet is molded from a plastic material having a specific gravity less than about 1.5 g/cc.

16. An adjustable weight camping mallet, comprising:

an elongate handle formed from a rigid plastic material having a specific gravity of less than about 1.5 g/cc and a Young's modulus of at least about 2 GPa, having a first longitudinal axis, and configured to be grasped by a user; and a mallet head formed from a rigid plastic material having a specific gravity of less than about 1.5 g/cc and a Young's modulus of at least about 2 GPa, that is integrally molded with or rigidly attached to a distal end of the elongate handle, and having a second longitudinal axis oriented substantially orthogonally relative to the first longitudinal axis, the mallet head including:

an outer wall formed from the rigid thermoplastic material, the rigid thermoplastic material forming an interior surface at least partially surrounding and defining an interior chamber into which weighting material can be selectively inserted or removed, the outer wall having a cross-sectional shape that is circular, oval, elliptical, triangular, rectangular, pentagonal, hexagonal, or polygonal;

one or more ribs extending along the second longitudinal axis to add strength and rigidity to the mallet head;

at least one hammering surface provided by, formed over, or supported by the rigid thermoplastic material;

an opening through the outer wall that provides access to the interior chamber; and a cover configured to selectively cover and uncover the opening.

17. An adjustable weight camping mallet as in claim 16, wherein the rigid plastic material comprises ABS plastic.

18. An adjustable weight camping mallet as in claim 16, the hammering surface further comprising a layer of metal formed over or supported by the rigid plastic material.

19. An adjustable weight camping mallet as in claim 18, wherein the adjustable weight mallet weighs less than about 340 g when the interior chamber is void of weighting material.

20. An adjustable weight camping mallet, comprising:

an elongate handle and a mallet head integrally formed from a single piece of rigid lightweight material having a specific gravity of less than about 4.5 g/cc, the elongate handle having a first longitudinal axis and being configured to be grasped by a user, the mallet head being attached to a distal end of the elongate handle and having a second longitudinal axis oriented laterally relative to the first longitudinal axis, the mallet head including:

an outer wall formed from the rigid lightweight material and providing an interior surface at least partially surrounding and defining an interior chamber into which weighting material can be selectively inserted or removed;

one or more ribs extending along the second longitudinal axis to add strength and rigidity to the mallet head;

a hammering surface on a first side of the mallet head provided by, formed over, or supported by the rigid lightweight material;

an opening through a second side of the mallet head opposite the first side that provides access to the interior chamber; and a cover on the second side of the mallet head configured to selectively cover and uncover the opening.

* * * * *